United States Patent [19]

Ishikawa et al.

[11] Patent Number: 4,759,839

[45] Date of Patent: Jul. 26, 1988

[54] PROCESS FOR PRODUCING PITCH USEFUL AS RAW MATERIAL FOR CARBON FIBERS

[75] Inventors: Seiji Ishikawa, Chiba; Shuuichi Hirano; Yukio Matsumoto, both of Ichihara; Tutomu Kaibara, Urawa; Kenji Sugiyama, Ube; Takuo Morishige, Onoda, all of Japan

[73] Assignees: Ube Industries, Ltd., Yamaguchi; Seibu Oil Company Limited, Tokyo, both of Japan

[21] Appl. No.: 915,992

[22] Filed: Oct. 3, 1986

[30] Foreign Application Priority Data

Oct. 8, 1985 [JP] Japan ..... 60-222831

[51] Int. Cl.[4] ..... C10C 3/00; C10C 3/02

[52] U.S. Cl. ..... 208/40; 208/39; 208/44; 423/447.2; 423/447.9

[58] Field of Search ..... 208/22, 39, 40, 44; 423/447.2, 449

[56] References Cited

U.S. PATENT DOCUMENTS

| | | | |
|---|---|---|---|
| 4,177,132 | 12/1979 | Uemura et al. | 208/22 |
| 4,454,019 | 4/1984 | Izumi et al. | 208/22 |
| 4,454,020 | 6/1984 | Izumi et al. | 208/22 |
| 4,469,667 | 9/1984 | Uemura et al. | 423/447.1 |
| 4,472,265 | 9/1984 | Otani | 208/44 |
| 4,504,455 | 3/1985 | Otani et al. | 423/447.6 |
| 4,512,874 | 4/1985 | Watanabe | 208/22 |
| 4,522,701 | 6/1985 | Dickakian | 208/22 |
| 4,528,087 | 7/1985 | Shibatani et al. | 208/22 |
| 4,529,498 | 7/1985 | Watanabe | 208/22 |
| 4,529,499 | 7/1985 | Watanabe | 208/22 |
| 4,575,412 | 3/1986 | Yudate et al. | 208/44 |
| 4,578,177 | 3/1986 | Yudate et al. | 208/44 |
| 4,581,124 | 4/1986 | Ceomi et al. | 208/34 |
| 4,597,853 | 7/1986 | Moriya et al. | 208/22 |
| 4,606,808 | 8/1986 | Yamada et al. | 208/22 |

*Primary Examiner*—Helen M. S. Sneed
*Assistant Examiner*—Helane Myers
*Attorney, Agent, or Firm*—Sherman and Shalloway

[57] ABSTRACT

A process for producing a pitch useful as a raw material for carbon fibers, which comprises (1) heat-treating at least one starting material selected from the group consisting of a heavy oil obtained by fluid catalytic cracking of a petroleum, a distillate or a residual oil obtained by distilling the heavy oil, and a pitch obtained by heat-treating any of the foregoing materials at a temperature of 350° to 550° C., (2) separating and removing insoluble substances from the reaction mixture obtained in step (1) to obtain a first treated mixture, (3) heating the first treated mixture obtained in step (2) at a temperature of 250° to 400° C. and removing light fractions which distill at said temperature to obtain a second treated mixture, and (4) treating the second treated mixture obtained in step (3) at a temperature of 430° to 550° C.

16 Claims, No Drawings

PROCESS FOR PRODUCING PITCH USEFUL AS RAW MATERIAL FOR CARBON FIBERS

This invention relates to a process for producing a pitch useful as a raw material for carbon fibers. More specifically, it pertains to a process for producing a pitch which has good melt spinnability and gives carbon fibers having excellent mechanical properties.

It has previously been known to produce carbon fibers using various pitches as raw materials. But some of such starting pitches have no sufficient melt spinnability, or the mechanical properties of the resulting fibers are still desired to be improved.

Japanese Laid-Open Patent Publication No. 19127/1974 discloses a method of obtaining a spinnable pitch by heat-treating a pitch to convert it to mesophase pitch. The resulting spinnable pitch is a mixture of mesophase pitch and isotropic pitch, and since these pitches have poor compatibility, it is difficult to spin the mixed pitch stably over an extended period of time.

Japanese Patent Publication No. 7533/1978 describes a process for producing a pitch useful as a raw material for carbon fibers which comprises heat-treating a petroleum-type tar pitch having a softening point of not more than 120° C., a quinoline-insoluble content of not more than 4% and a carbon content of 92 to 95% at a temperature of not more than 350° C. in the presence of a Lewis acid catalyst, removing the catalyst, and then heating the product at a temperature of 350° to 500° C. The resulting pitch is characterized by having a softening point of 200° to 300° C. and containing a mesophase.

Japanese Patent Publication No. 179286/1982 discloses a process for producing a pitch useful as a raw material for carbon fibers, which comprises heat-treating a mixture of (1) 100 parts by volume of a heavy oil having a boiling point of at least 200° C. obtained by fluid catalytic cracking of petroleums and (2) 10 to 200 parts by volume of a hydrogenated product of a fraction having a boiling point of 160° to 400 ° C. derived from a pitch, at a temperature of 380° to 480° C. under a pressure of 2 to 50 kg/cm$^2$-G.

Japanese Laid-Open Patent Publication No. 18421/1983 describes a process for producing carbon fibers, which comprises spinning an optically isotropic premesophase carbonaceous material or a pitch-like substance composed mainly of a premesophase carbonaceous material under such conditions that the amount of a mesophase carbonaceous material does not substantially increase, then subjecting the fibers to a treatment of rendering them infusible and then to a carbonization treatment to thereby convert substantially all of the premesophase carbonaceous material into an optically anisotropic mesophase carbonaceous material. The patent document states that the optically isotropic premesophase carbonaceous material is produced by treating a pitch with tetrahydroquinoline which is expensive, or with quinoline and hydrogen in the presence of a catalyst, or with an aromatic hydrocarbon and hydrogen.

It is an object of this invention to provide a novel process for producing a pitch useful as a raw material for production of carbon fibers.

Another object of this invention is to provide a novel process for producing a pitch having good spinnability.

Still another object of this invention is to provide a novel process for producing a pitch which gives carbon fibers having excellent mechanical properties.

Yet another object of this invention is to provide a novel process for producing a carbon fiber-forming pitch having the aforesaid excellent properties by a simple operation.

Further objects of this invention along with its advantages will become apparent from the following description.

These objects and advantages of the invention are achieved in accordance with this invention by a process for producing a pitch useful as a raw material for carbon fibers, which comprises (1) heat-treating at least one starting material selected from the group consisting of a heavy oil obtained by fluid catalytic cracking of a petroleum, a distillate or a residual oil obtained by distilling the heavy oil, and a pitch obtained by heat-treating any of the foregoing materials at a temperature of 350° to 550° C., (2) separating and removing insoluble substances from the reaction mixture obtained in step (1) to obtain a first treated mixture, (3) heating the first treated mixture obtained in step (2) at a temperature of 250° to 400° C. and removing light fractions which distill at said temperature to obtain a second treated mixture, and (4) treating the second treated mixture obtained in step (3) at a temperature of 430° to 550° C.

In the first step of the process of this invention, at least one of a heavy oil obtained by fluid catalytic cracking of a petroleum, a distillate or a residual oil (distillation residue) obtained by distilling the heavy oil, and a pitch obtained by heat-treating any one of the foregoing materials is used as a starting material.

The heavy oil is a cracked oil obtained by cracking a petroleum at a temperature of about 480° to 560° C. in the presence of a silica/alumina-type cracking catalyst or a zeolite-type cracking catalyst in a fluidized bed, and usually contains some amount of the catalyst powder entrained therein. The heavy oil has a boiling point of usually 200° to 560° C., preferably 300° to 560° C.

The heavy oil may be used as the starting material without removing the catalyst powder. Alternatively, a distillate having a suitable boiling range or a residual oil obtained by distilling the heavy oil, or a pitch obtained by heat-treating the heavy oil or the distillate or residual oil may be used as the starting material in the present invention. The heat-treatment for obtaining the pitch may be carried out conveniently at a temperature of, for example, 350° to 450° C.

If desired, a cycle oil recovered from the fluid catalytic cracking apparatus may be added to such a starting material and the mixture heat-treated at a temperature of 350° to 550° C., before the starting material is submitted to the process of this invention. When this heat-treatment is carried out in the presence of a silica/alumina-type cracking catalyst, a zeolite-type cracking catalyst or an alumina/magnesia-type cracking catalyst, the resulting starting material leads to a pitch having better spinnability. These catalysts are known per se as catalysts for fluid catalytic cracking of petroleums. The heat-treatment is carried out preferably at a temperature of 420° to 550° C. The heat-treatment time is preferably 10 minutes to 3 hours, especially about 20 minutes to 60 minutes.

In the second step of this invention, insoluble solid substances such as a coke-like substance, the catalyst powder contained in the starting material or the catalyst added in the first step are separated and removed from the reaction mixture obtained in the first step. Separation and removal may be carried out, for example, by filtration, preferably filtration under reduced or elevated pressure, or by centrifugal separation.

In the third step of the process of this invention, the mixture obtained by separating and removing the insoluble substances (a first treated mixture) is heated at a temperature of 250° to 400° C., preferably 320° to 380° C., to remove light components formed mainly in the first step as light fractions which distill at the above temperatures used. Advantageously, the third step is carried out under a reduced pressure of, for example, up to 1 mmHg while passing an inert gas such as nitrogen gas.

The fourth step of the process of this invention is especially important in this invention. In the fourth step, the second mixture obtained by removing the light fractions in the third step is further treated at a temperature of 430 ° to 550° C., preferably 450° to 500° C. Preferably, the fourth step is carried out in a stream of an inert gas such as nitrogen under reduced pressure. The heat-treatment in the fourth step is carried out preferably for about 10 to 60 minutes.

Desirably, the temperature used in the fourth step is elevated from the temperature of the third step as quickly as possible, for example, within 5 to 30 minutes.

The treatment in the fourth step is important to the production of a pitch having good spinnability. If this treatment is insufficient, the resulting pitch may have a low softening point although having good spinnability. To obtain carbon fibers from the pitch having a low softening point, the treatment of the spun fibers to render them infusible must be carried out at low temperatures for a long period of time. Such a treatment is economically disadvantageous. On the other hand, when the heat-treatment is carried out excessively, the resulting pitch has too high a softening point. When spun, such a pitch is liable to form a coke-like substance during spinning, and filament breakage may occur frequently.

Advantageously, the heat-treatment in the fourth step is carried out within relatively short periods of time to avoid excessive treatment under the above conditions so that the resulting pitch will have a softening point of preferably 260° to 340° C., more preferably 280° to 320° C. The pitch obtained in the fourth step has a toluene-insoluble content (after extraction at 110° C. for 1 hour; to be referred to as TI) of 50 to 90% and a quinoline-insoluble content (after extraction at 75° C. for 1 hour; to be referred to as QI) of 10 to 40%.

The starting pitch produced by the process of this invention can be melt-spun from a spinneret by methods known per se to form pitch fibers. The starting pitch shows good spinnability with very few filament breakage during melt spinning. The pitch fibers can then be rendered infusible by maintaining them at a temperature of, for example, 200° to 350° C. for 15 minutes to 2 hours. By maintaining the infusible fibers at a temperature of, for example, 1,000° to 2,500° C. for 10 to 60 minutes, they are converted into carbon fibers.

The carbon fibers produced as above from the starting pitch obtained in this invention have very superior mechanical properties such as high tenacity and moduli as specifically described in the following working examples.

In the present application, the toluene-insoluble content (TI) and quinoline-insoluble content (QI) are measured by the following methods.

TI

About 3 g of the pitch precisely weighed was put in 30 ml of toluene, and the mixture was refluxed for 1 hour The insoluble matter was separated by filtration at room temperature, and dried under reduced pressure at 100° C. The weight of the insoluble matter was measured, and TI was calculated.

QI

About 2 g of the pitch precisely weighed was put in 30 ml of quinoline and the mixture was maintained at 75° C. for 1 hour. The insoluble matter was separated by filtration at room temperature, and dried under reduced pressure at 100° C. The weight of the insoluble matter was measured, and QI was calculated.

The following examples illustrate the present invention more specifically.

EXAMPLE 1

(1) A 500 ml autoclave was charged with 235 g of a heavy oil (to be referred to as the FCC oil) obtained by fluid catalytic cracking of a petroleum and 25 g of a silica/alumina-type cracking catalyst. The air inside the autoclave was replaced by nitrogen gas, and the pressure of the inside of the autoclave was adjusted to 30 kg/cm$^2$ with hydrogen. Then, with stirring, the autoclave was heated from 250° C. to 440° C. at an average temperature-elevating rate of 2.5° C./min., and maintained at 440° C. for 30 minutes. The pressure of the inside of the autoclave increased with time, and finally reached 94 kg/cm$^2$. After a predetermined period of time, the autoclave was immediately withdrawn from a heating bath and allowed to cool to room temperature. The heat-treated product was filtered through a filter paper under pressure at an elevated temperature to remove the fine catalyst powder. The product was distilled under reduced pressure in a three-necked separable flask equipped with a stirrer, and fractions having a degree of pressure reduction of less than 5 mmHg and a temperature of less than 350° C. were recovered, and 34 g of a pitch having a softening point of 130° C. and a TI of 5.0% was obtained as a residue.

(2) The pitch was placed in a three-necked stainless steel separable container equipped with a stirrer and set over a tin bath previously heated to 460° C. to melt the pitch. Thereafter, the entire container was immersed in the tin bath and at the same time, nitrogen gas was passed through the container. After the distillate vigorously flowed out, the reaction mixture was maintained under a reduced pressure of 3 mmHg for 15 minutes to remove the decomposed distillate. Immediately after completion of removal of the decomposed distillate, the container was taken out from the tin bath. The inside of the container was cooled to room temperature while maintaining it in a nitrogen gas atmosphere. There was obtained 15 g of a residual pitch having a softening point of 288° C., a TI of 69.7% and a QI of 14.0% as a raw material for spinning.

(3) The pitch was melt-spun at 350° C. from a spinneret having a nozzle with a diameter of 0.3 mm to obtain a pitch fiber having a diameter of 11 micrometers. The pitch had excellent spinnability without filament breakage for more than 30 minutes. The pitch fiber was heated in an air atmosphere from 50° C. to 300° C. at a temperature-elevating rate of 3° C./min., and maintained at this temperature for 30 minutes to obtain an infusibilized fiber. The infusibilized fiber was heated in a nitrogen atmosphere to 1500° C. at a temperature-elevating rate of 30° C./min., and maintained at this temperature for 10 minutes to obtain a carbon fiber. The carbon fiber had a tenacity of 244 kg/mm$^2$, a modulus of 23.7 tons/mm$^2$ and an elongation of 1.4% as measured in accordance with JIS R7601 (Method of Testing Carbon Fibers).

It will be obvious to those skilled in the art that by heat-treating this carbon fiber further at a high temperature to induce advanced graphatization, the carbon fiber will have an increased tenacity, modulus and elongation.

EXAMPLE 2

(1) A pitch (50.8 g) having a softening point of 122° C. and a TI of 5.0% was produced by the same method as described in Example 1, (1) except that 150 g of the FCC oil and 75 g of an oil having a softening point of 76° C. and a boiling point of more than 460° C. (calculated for atmospheric pressure) derived from the FCC oil were used as the starting material. The resulting pitch was treated in the same way as in Example 1, (2) except that the temperature, the pressure and the time were changed to 460° C., 5 mmHg, and 20 minutes, respectively, to give 23.0 g of a spinnable pitch having a softening point of 290° C., a TI of 74.7% and a QI of 34.7%. The pitch had good spinnability. When it was spun and treated in the same way as in Example 1, (3), a carbon fiber having a tenacity of 248 kg/mm$^2$, a modulus of 29.8 tons/mm$^2$ and an elongation of 1.2% was obtained.

EXAMPLE 3

A pitch (38.7 g) having a softening point of 120° C. and a TI of 2.8% was produced by the same method as described in Example 1, (1) except that 75 g of a pitch having a softening point of 105° C. and a TI of 12.5% obtained by heat-treating the FCC oil and 150 g of fractions recovered at temperatures of up to 375° C. (calculated for atmospheric pressure) from the FCC oil were used as the starting material. The pitch was then treated in the same way as in Example 1, (2) except that the temperature, the pressure and the time were changed to 460° C., 3 mmHg, and 17 minutes, respectively, to give 20.5 g of a spinnable pitch having a softening point of 284° C., a TI of 93.3% and a QI of 36.5%. The pitch had good spinnability. The resulting pitch was spun and treated in the same way as in Example 1, (3) to give a carbon fiber having a tenacity of 258 kg/mm$^2$, a modulus of 19.0 tons/mm$^2$ and an elongation of 1.5%.

EXAMPLE 4

In this example, the high-temperature treatment in the presence of the cracking catalyst in Example 1, (1) was carried out in the absence of hydrogen.

A pitch (31.4 g) having a softening point of 133° C. and a TI of 4.3% was produced in the same way as in Example 1, (1) except that the high-temperature treatment in the presence of the cracking catalyst was carried out in the absence of hydrogen. The pitch was treated in the same way as in Example 1, (2) except that the temperature, the pressure and the time were changed to 460° C., 6 mmHg and 10 minutes, respectively, to give 15.3 g of a spinnable pitch having a softening point of 278° C., a TI of 51.3% and a QI of 20%. This pitch had good spinnability. When spun and treated in the same way as in Example 1, (3), it gave a carbon fiber having a tenacity of 210 kg/mm$^2$, a modulus of 17.8 tons/mm$^2$ and an elongation of 1.0%.

EXAMPLE 5

In this Example, a zeolite-type catalyst was used as the cracking catalyst in the first step.

A pitch (42.3 g) having a softening point of 115° C. and a TI of 3.2% was produced by the same method as in Example 1, (1) except that 80 g of a pitch having a softening point of 105° C. and a TI of 12.5% obtained by heat-treating the FCC oil and 160 g of fractions having a boiling point of up to 375° C. (calculated for atmospheric pressure) derived from the FCC oil were used as the starting material, and 24 g of the zeolite-type catalyst was used instead of the silica/alumina-type catalyst. The resulting pitch was treated in the same way as in Example 1, (2) except that the temperature, the pressure and the were changed to 460° C., 3 mmHg and 17 minutes, respectively, to give 21.9 g of a spinnable pitch having a softening point of 291° C., a TI of 90.4% and a QI of 32.5%. This pitch had good spinnability. When spun and treated as in Example 1, (3), it gave a carbon fiber having a tenacity of 246 kg/cm$^2$, a modulus of 18.6 tons/mm$^2$ and an elongation of 1.5%.

EXAMPLE 6

A pitch (64.3 g) having a softening point of 108° C. and a TI of 5.3% was produced by the same method as in Example 1, (1) except that 80 g of a pitch having a softening point of 87° C. and a TI of 1.7% obtained by distilling the FCC oil under reduced pressure and 80 g of a light cycle oil (boiling range 218° to 352° C.) recovered from a fluid catalytic cracking device were used as the starting material, 16 g of a zeolite-type catalyst was used instead of the silica/alumina-type catalyst, and the heat-treatment was carried out at 430° C. for 20 minutes. The resulting pitch was treated in the same way as in Example 1, (2) except that the temperature, the pressure and the time were changed to 475° C., 5 mmHg and 13 minutes, respectively, to give 26.3 g of a spinnable pitch having a softening point of 275° C., a TI of 81.7% and a QI of 36.0%. The pitch had good spinnability, and when spun and treated as in Example 1, (3), gave a carbon fiber having a tenacity of 235 kg/mm$^2$, a modulus of 23.0 tons/mm$^2$ and an elongation of 1.4%.

EXAMPLE 7

A pitch (53.4 g) having a softening point of 133° C. and a TI of 8.3% was produced by the same method as in Example 1, (1) except that 80 g of the pitch and 160 g of the light cycle oil which are described in Example 6 were used as the starting material, the cracking catalyst was not used, and the heat-treatment was carried out at 430° C. under an initial hydrogen pressure of 30 kg/cm$^2$ for 20 minutes. The pitch was treated in the same way as in Example 6 to give 30.0 g of a spinnable pitch having a softening point of 288° C., a TI of 89.3% and a QI of 38.5%. The spinnability of this pitch was slightly worse, but when spun and treated as in Example 1, (3), it gave a carbon fiber having a tenacity of 219 kg/mm$^2$, a modulus of 17.5 tons/mm$^2$ and an elongation of 1.3%.

What we claim is:

1. A process for producing a pitch useful as a raw material for carbon fibers, which comprises (1) heat-treating in an autoclave, under pressure, at least one starting material consisting essentially of heavy oil or a treated product of heavy oil and selected from the group consisting of a heavy oil obtained by fluid catalytic cracking of a petroleum, a distillate or a residual oil obtained by distilling the heavy oil, and a pitch obtained by heat-treating any of the foregoing materials at a temperature of 350° to 550° C., (2) separating and removing insoluble, coke-like and catalyst substances from the reaction mixture obtained in step (1) to obtain a first treated mixture, (3) heating the first treated mixture obtained in step (2) at a temperature of 250° to 400° C. and removing light fractions which distill at said temperature to obtain a second treated mixture, and (4) treating the second treated mixture obtained in step (3) at a temperature of 430° to 550° C. for 10 minutes to 60 minutes.

2. The process of claim 1 wherein the starting material is a heavy oil which is obtained from a cracked oil produced by cracking a petroleum at a temperature of 480° to 560° C. in the presence of a cracking catalyst in a fluidized bed and which contains the cracking catalyst entrained therein, a distillate or a distillation residue of the heavy oil, or a pitch obtained by heat-treating any one of the foregoing materials.

3. The process of claim 1 wherein the heat-treatment in step (1) is carried out in the presence of a cracking catalyst.

4. The process of claim 3 wherein the cracking catalyst is a silica/alumina catalyst or a zeolite catalyst.

5. The process of claim 1 wherein the heat-treatment in step (1) is carried out at a temperature of 420° to 550° C.

6. The process of claim 1 wherein the heat-treatment in step (1) is carried out for 10 minutes to 3 hours.

7. The process of claim 1 wherein the heat-treatment in step (1) is carried out in a hydrogen atmosphere.

8. The process of claim 1 wherein in step (1), a light or heavy cycle oil recovered from a fluidized catalytic cracking device is added to the starting material before submitting it to the heat-treatment.

9. The process of claim 1 wherein in step (2), the insoluble substances are separated and removed by filtration or centrifugal separation.

10. The process of claim 1 wherein the heating in step (3) is carried out at a temperature of 320° to 380° C.

11. The process of claim 1 wherein the heating in step (3) is carried out under reduced pressure in an atmosphere of an inert gas.

12. The process of claim 1 wherein the heat-treatment in step (4) is carried out at a temperatgure of 450° to 500° C.

13. The process of claim 1 wherein the heat-treatment in step (4) is carried out under reduced pressure in an atmosphere of an inert gas.

14. The process of claim 1 wherein the pitch obtained in step (4) has a softening point of 260° to 340° C.

15. The process of claim 1 wherein the pitch obtained in step (4) has a toluene-insoluble content of 50 to 90%.

16. The process of claim 1 wherein the pitch obtained in step (4) has a quinoline-insoluble content of 10 to 40%.

* * * * *